United States Patent [19]

Sujata et al.

[11] Patent Number: 4,785,748

[45] Date of Patent: Nov. 22, 1988

[54] METHOD SUDDEN EXPANSION (SUE) INCINERATOR FOR DESTROYING HAZARDOUS MATERIALS & WASTES

[75] Inventors: Mark L. Sujata, Northridge; Thomas D. Burnette, Westlake Village; H. Clyde Long, Jr., Simi Valley; Raymond E. Wieveg, Ventura, all of Calif.

[73] Assignee: The Marquardt Company, Van Nuys, Calif.

[21] Appl. No.: 88,558

[22] Filed: Aug. 24, 1987

[51] Int. Cl.[4] ..... F23G 7/04

[52] U.S. Cl. ..... 110/238; 110/346

[58] Field of Search ..... 110/238, 346; 431/264

[56] References Cited

U.S. PATENT DOCUMENTS

| | | | |
|---|---|---|---|
| 3,830,172 | 8/1974 | Hindenlang | 110/238 |
| 3,894,833 | 7/1975 | Rinecker | 110/238 |
| 4,094,625 | 6/1978 | Wang et al. | 110/238 X |
| 4,337,029 | 6/1982 | McElroy et al. | 431/264 |
| 4,409,908 | 10/1983 | Udyma et al. | 110/238 X |
| 4,628,835 | 12/1986 | Wollner | 110/346 X |

*Primary Examiner*—Edward G. Favors

*Attorney, Agent, or Firm*—John J. Posta, Jr.

[57] ABSTRACT

The method of incinerating hazardous materials and fluidizable wastes, such as liquids, gases, entrained solid particles, fumes and slurries, utilizes an incinerator in the form of a sudden expansion burner. The incinerator has a relatively small diameter cylindrical inlet pipe connected by a circular plate to a relatively larger diameter elongated cylindrical combustion chamber. A waste injection line passes into the incinerator adjacent the inlet pipe for transfer of incineratable waste therethrough and into the upstream end of the combustion chamber. Air inlets connected to a blower also terminate adjacent the inlet pipe for supplying air at a high flow rate to the combustion chamber. One or more fuel nozzles extend through the plate into the combustion chamber to provide an overstoichiometric concentration of fuel adjacent the plate. The fuel is ignited through an electrically powered, fuel supplied ignitor extending into the combustion chamber through the inlet pipe. The supply of fuel, waste, air and igniter fuel are monitored. Total combustion of hazardous waste materials is carried very rapidly out by utilizing the present method and incinerator.

16 Claims, 2 Drawing Sheets

AIR INTAKE CONTROL SYSTEM
IGNITER FUEL SUPPLY CONTROL SYSTEM
FUEL SUPPLY CONTROL SYSTEM WITH FLAME DETECTION & AIR FLOW SAFETY INTERLOCKS
FUEL SUPPLY LINE
GASEOUS WASTE INJECTION LINE
LIQUID WASTE INJECTION LINE
10
12
14
16
17
18
20
22
24
26
28
30
32
34
36
38
40
42
44
46
48
50
52
54
56
60
100
101

METHOD SUDDEN EXPANSION (SUE) INCINERATOR FOR DESTROYING HAZARDOUS MATERIALS & WASTES

BACKGROUND OF THE INVENTION

1. Field of the Invention

The present invention generally relates to waste materials and, more particularly, to an improved method and apparatus for completely incinerating such materials.

2. Prior Art

Hazardous waste materials represent a serious challenge to human and animal health and to the environment in general. Recently, concerted efforts have been made to dispose of such waste materials in a safe manner, in many cases by dumping them in deep land fill zones. In other cases the hazardous materials are encased in protective containers and buried in land fills or at sea. Certain hazardous materials are also disposed of by burning them at trash dumps, in commercial furnaces and the like. Depending on the burning parameters, such destruction frequently is time-consuming, incomplete and produces noxious levels of nitrogen oxide and other undesired pollutants.

There remains a need for a simple, inexpensive, efficient method and apparatus for completely and rapidly incinerating hazardous and non-hazardous waste materials, particularly fluidizable materials, such as liquids, gases, entrained particles and slurries, without generating noxious by-products.

SUMMARY OF THE INVENTION

The improved method and waste incinerator of the present invention satisfy all the foregoing needs. The method and apparatus are substantially as set forth in the Abstract. Thus, the incinerator is a sudden expansion burner such as is currently used to produce high temperature gases for commercial heating and treating processes and testing facilities. One such burner is illustrated and described in U.S. Pat. No. 3,074,469. It has now been discovered that such a gas-generating burner can be successfully used in the present method to completely consume hazardous and non-hazardous fluidized waste without producing noxious by-products such as nitrogen oxides and the like air pollutants.

In the present method, waste to be burned is injected as a stream into the incinerator adjacent the small diameter cylindrical pipe inlet thereof and passes through that pipe, together with air blown to the inlet pipe, preferably from a cooling jacket which surrounds the combustion chamber portion of the incinerator. If the waste comprises fumes or a mass of small particles, it is air blown into the air supply stream and thus fluidized and brought into the combustion zone. The inlet pipe is concentric with and connected to the larger diameter cylindrical combustion chamber by a circular flat plate through which fuel injection nozzles extend into the combustion chamber.

The device also includes an electrically powered igniter extending through the pipe inlet to the combustion chamber and supplied with igniter fuel. Controls are provided for the igniter, air, fuel and waste supply systems.

Fuel is supplied to the upstream end of the combustion-chamber. If the waste is a liquid or gas capable of sustaining combusion at more than 5000 BTU's/lb., it can be premixed with the fuel and injected therewith, rather than separately. The sudden expansion between the smaller inlet pipe and the combustion chamber has the effect of acting as a flame holder, permitting stable and complete combustion of waste and fuel in the incinerator without generating nitrous oxides and other pollutants in significant concentrations. The fuel, air and waste while being consumed pass entirely through the elongated combustion chamber from the overstoichiometric area thereof to an understoichiometric downstream area. Highly reactive ions are generated in the combustion process to facilitate the more rapid and complete incineration of waste than in previous methods.

The incinerator can be any suitable size and shape capable of producing the desired results, for example, an inlet pipe as small as 3 inches in diameter with the combustion chamber 6 inches in diameter, or an inlet pipe larger than 20 inches in diameter with the combustion chamber 40 inches in diameter. The overall combustion chamber and/or incinerator length can range from 1 to 30 feet in length.

Further features of the invention are set forth in the following detailed description and accompanying drawings.

DRAWINGS

DETAILED DESCRIPTION

Figure 1:
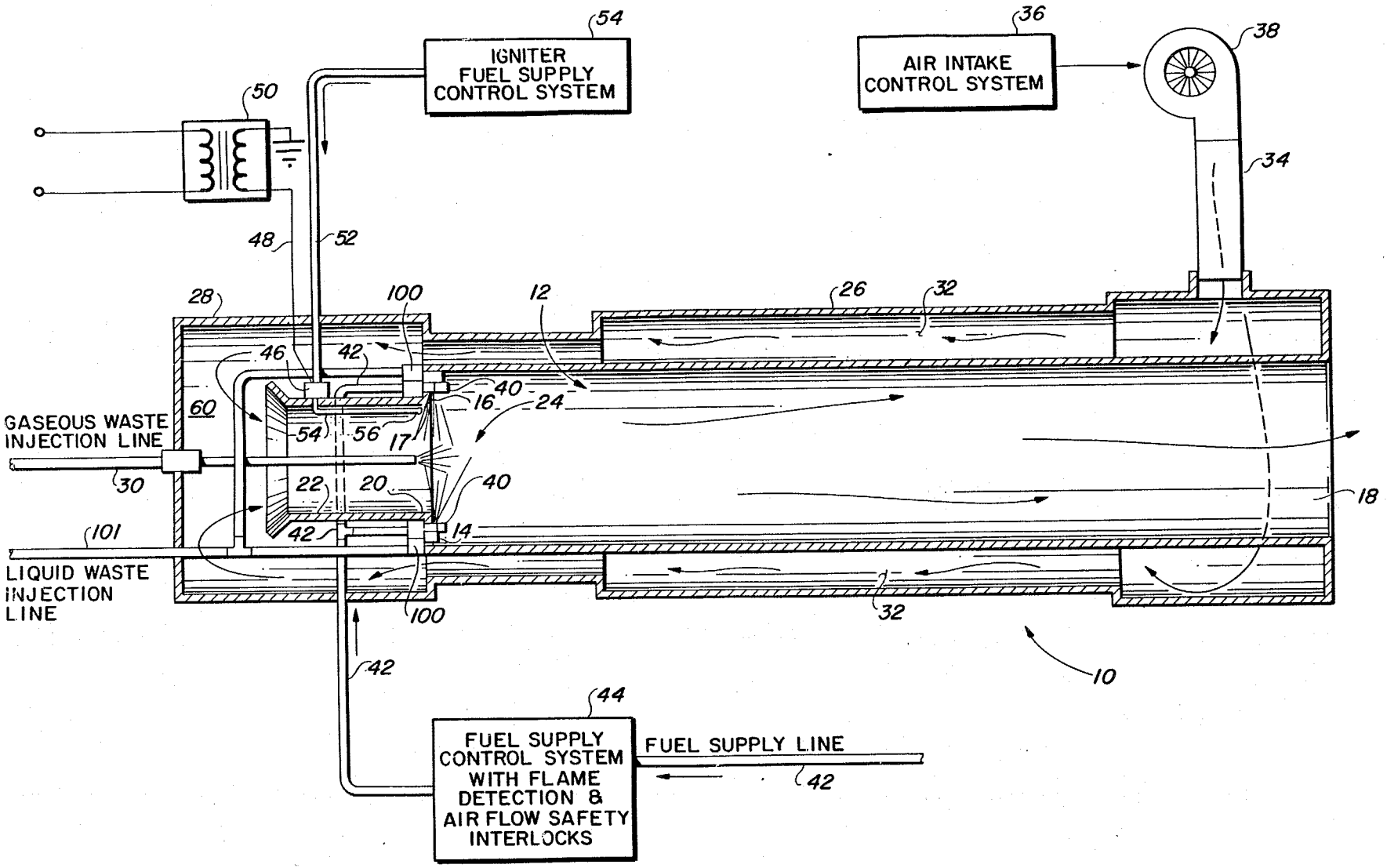
FIG. 1 is a cross-section of a preferred embodiment of the improved incinerator of the present invention.
Figure 2:
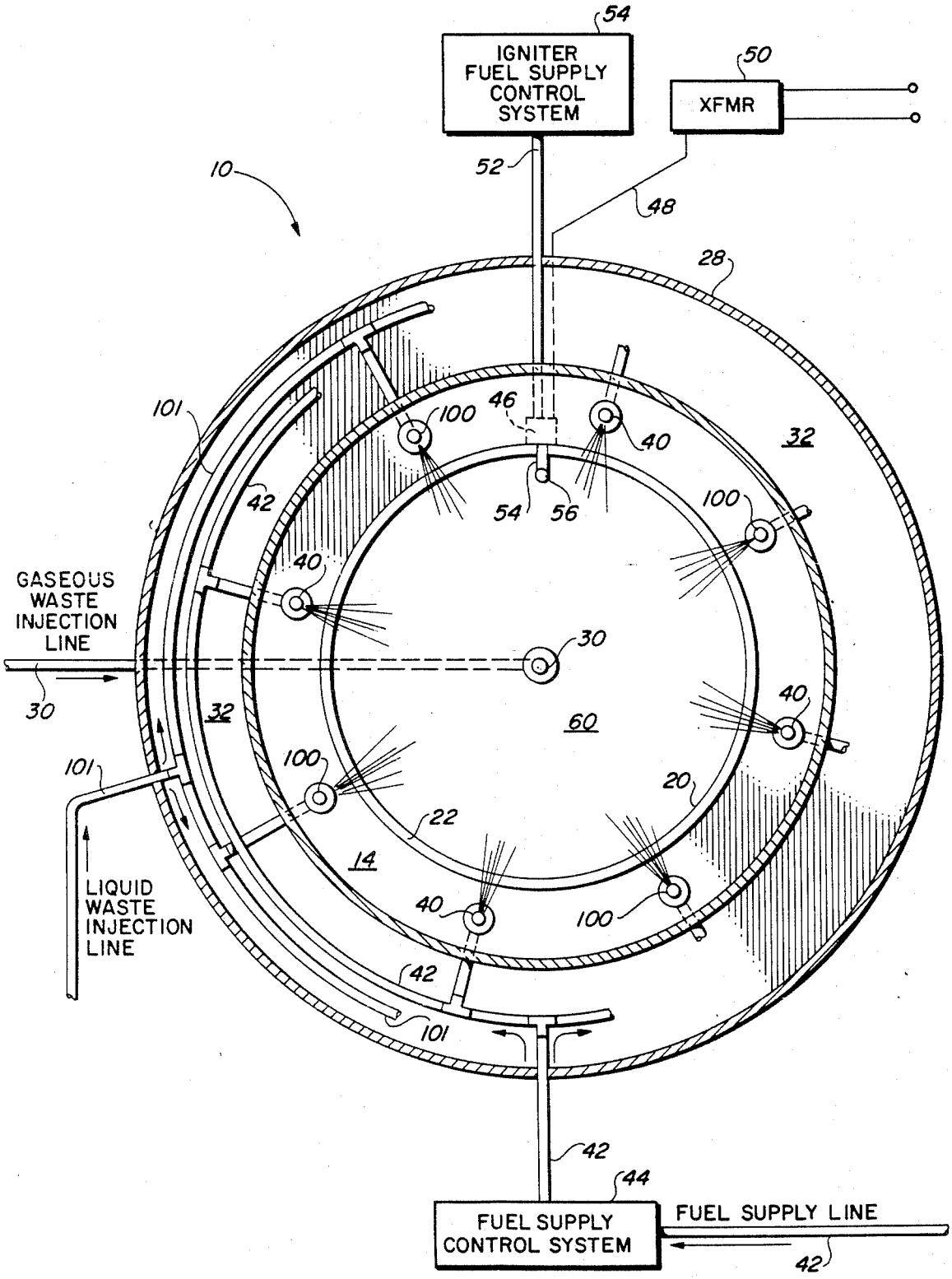
FIG. 2 is an end sectional view of the incinerator shown in FIG. 1.

Now referring more particularly to the accompanying single FIGS. 1 and 2 of the drawings, a preferred embodiment of the improved waste incinerator of the present invention is schematically depicted therein. Thus, incinerator 10 is shown which may be of any suitable size and shape, as previously described, and which comprises an elongated preferably cylindrical pipe serving as combustion chamber 12.

Chamber 12 is connected at its upstream end 14 to a circular plate 16 bearing an opening 17 therein. Pipe 22 is concentric with combustion chamber 12 and is of smaller diameter than chamber 12. Chamber 12 is open at its downstream end 20 of a preferably cylindrical inlet pipe 22 which is open at its upstream end 60 eventually passing through inlet pipe 22 into the reaction zone area 24 where mixing and combustion is initiated.

Incinerator 10 may also include an outer cooling jacket 26 around combustion chamber 12 and which may connect to a closed hollow antechamber 28 upstream of and surrounding pipe 22. A gaseous waste injection line 30 extends into antechamber 28 and is aligned with the upstream end 60 of pipe 22 for delivery of gaseous material, hazardous or non-hazardous, into pipe 22 and therethrough and into the upstream end 24 of combustion chamber 12. Waste in the form of gas, fumes, or entrained particles are delivered to incinerator 10 through line 30 and liquid hazardous materials or waste materials are delivered to incinerator 10 through line 101 to injectors 100. Injectors 100 are located on circular plate 16, and may number from 2–16 for adequate liquid injection. The Liquid Waste Injectors 100 spray the liquid into the reaction zone 24 and can also be located within the Fuel Injectors 40. Flows into the reaction zone 24 and through the combustion chamber 10 can occur at any desired rate, depending on the size and operating conditions of incinerator 10.

In incinerator 10, air passes through a space 32 from line 34 in which an air intake control system 36 of conventional type and a blower 38 are disposed, and into antechamber 28 and then into inlet end 60 of pipe 22 for delivery to chamber 12, sweeping gaseous waste from line 30 with it. Preferably, air is delivered to chamber 12 at a flow rate, for the average size incinerator 10 (about 12" diameter×120" long), of about 800 to about 1400 cu. ft/min. Obviously, the air flow rate will vary with the size and operating conditions of the incinerator and with the nature of the waste material and fuel.

Incinerator 10 also includes a plurality of both fuel injector nozzles 40 and liquid waste nozzles 101 supported by plate 16 and extending to the end 14 of chamber 12. Fuel Nozzles 40 and liquid waste nozzles 101 are connected by fuel and waste supply lines respectively, generally designated to a fuel supply control system 44 and waste supply lines 101 which may have conventional flame detection and air flow safety interlocks. Fuels such as methane, propane, acetylene, and other gaseous or liquid hydrocarbon fuels can be be supplied through lines 42 and nozzles to chamber 12 at any suitable flow rate, e.g., about 1.4 to about 3.0 lbs/min. The incinerator is also capable of sustaining combustion with certain hazardous materials by shutting off the Fuel Supply Control System line 42 and Injectors 40 and supporting combustion solely from liquid hazardous material injection line 101 to the liquid waste injectors 100. Automatic fuel addition as required to maintain adequate combustion of waste injector 100 material can also be integrated.

Incinerator 10 also includes conventional means for igniting the fuel delivered to chamber 12 to initiate combustion therein. For this purpose, an igniter 46, electrically powered through line 48 from a transformer 50 and supplied by igniter fuel, such as propane, through lines 52 from a control system 54, is connected to pipe 22 and has an igniter pipe and tip 54, is connected to pipe 22 and has an igniter pipe and tip 56 extending through pipe 22 into the upstream end 24 of chamber 12 for ignition of fuel, air and waste delivered thereto as previously described.

In practicing the present method, air flow into end of chamber 12 is initiated by activating blower 38. Fuel and liquid waste is simultaneously supplied through lines 42 and 101 and nozzles 40 and 100 into reaction zone area 24, and the air-fuel mixture is ignited by igniter 56's flame, itself initiated electrically on igniter fuel supplied through line 52.

Once the fuel-air mixture is ignited and sustained by the continued flow of fuel and air into 24, other gaseous waste to be completely incinerated is passed through line 30 and is swept by air into 24. It flows with air, fuel and flame downstream in combustion chamber 12, eventually being totally consumed, along with the fuel and air producing only innocuous gases which exit chamber 12 through open end 18. The following examples further illustrate certain features of the invention.

It should be noted that "hazardous waste" as used within this description is intended to include any and all hazardous materials, hazardous waste, non-waste materials, gaseous, and/or particulate contaminants to be destroyed by the incineration process.

EXAMPLE I

A sudden expansion incinerator, of the all metal (steel) step plate type, is used. The incinerator is fabricated from all metal (steel) and consists of a large cylindrical open-ended pipe, 12 inches in diameter and 120 inches long, which serves as the combustion chamber, and which is connected to a concentric cylindrical open ended inlet pipe about 6 inches in diameter and 12 inches long by a flat circular plate with a 6 inch diameter central opening. Air is caused to flow through an outer cooling jacket around the combustion chamber and inlet pipe and connected to a closed antechamber and into the upstream end of the combustion chamber through the inlet pipe at about 1250 cu. ft/min., while propane fuel is fed into the chamber upstream end through a plurality of nozzles extending through the flat plate and at the flow rate of 2.5 cu.ft./min.

The fuel-air mixture is ignited by a propane gas flame from an igniter. After combustion begins in the combustion chamber, waste material in the form of gas or liquid is passed into the antechamber and is swept by the air flow through the inlet pipe and chambers upstream end at the flow rate of 1 to 5 lbs/min.

Residence time of the waste material in the combustion chamber is about 0.12 seconds, with an average combustion temperature of about 2000° f.

Only nitrous oxide-free and other contaminant-free gases are produced as the combustion continues from the upstream end to the downstream end, and such gases exit the conbustion chamber to the atmosphere. The method and apparatus are safe, efficient, rapid and inexpensive.

EXAMPLE II

An incinerator identical to that of Example I is used, except that the incinerator has a combustion chamber of 20×200 inches, and a small inlet pipe of 10×20 inches. No separate injection line is used. Instead, waste fluid in the form of liquid, capable of sustaining combustion at more than 5000 BTU's/lb. is injected through nozzles in the expansion plate along with the propane fuel into the combustion chamber at the flow rate of 3 to 10 lbs/min., while air is passed thereto at the flow rate of 3500 cu. ft/min. The waste residence time is about 0.12 seconds, the combustion temperature is about 2000 ° f. and the waste is completely consumed, with only non-toxic, non-polluting gases being produced by the method.

Various other modifications, changes, alterations and additions can be made in the improved waste incinerator and incineration method of the present invention, their components, steps and parameters. All such modifications, changes, alterations and additions as are within the scope of the appended claims form part of the present invention.

What is claimed is:

1. An improved method of incinerating fluidizable materials, said method comprising:

(a) providing a sudden expansion burner having a housing with a relatively small diameter waste, air and fuel inlet component, a relatively larger diameter, elongated combustion chamber, and a plurality of fuel nozzles and waste injection nozzles extending radially about said inlet component, (b) introducing air into said inlet component, (c) injecting fluidized waste material from said waste injection nozzles directly inwardly to a combustion zones at the axis of rotation of said burner housing and combustion chamber and in an area immediately downstream of said burner housing, (d) simultaneously injecting fuel from said fuel nozzles directly inwardly to said combustion zone, (e) igniting the air, fuel and waste material in said combustion zone, (f) passing said fluidized material and fuel downstream through said zone until consumed by combustion; and, (g) continuing to inject additional of said air, fuel and fluidizable material until a predetermined amount of said fluidizable material is totally flame consumed in said burner without production of toxic or polluting gases.

2. The improved method of claim 1 wherein a waste gas injector is provided within said inlet component along the axis of rotation of said burner housing to introduce therethrough gaseous waste material directly to said combustion zone, and injecting gaseous waste material from said waste gas injector into said combustion zone.

3. The improved method of claim 2 wherein the injection of fuel into said combustion zone is terminated after determining that the combustion of the waste material is capable of being self-sustaining.

4. The improved method of claim 1 wherein said burner comprises a relatively small diameter pipe joined at one end by a step plate to a relatively larger diameter pipe, said small diameter pipe serving as the site of injection of said air and waste into said burner, and said plate serving as the site of injection of said fuel into said burner and said large diameter pipe serving as the site of said combustion zone, a point adjacent said plate in said large pipe being the site of sudden fluid expansion in said zone for stable efficient combustion of waste.

5. The improved method of claim 4 wherein propane fuel is injected into said combustion zone and wherein said fluidizable material is waste in the form of fluid capable of sustaining combustion at more than 5000 BTU's/lb.

6. The improved method of claim 5 wherein said large pipe is disposed in a cooling jacket adapted to passing cooling air or water around the outside of said large pipe.

7. The improved method of claim 6 wherein said waste is passed through said small diameter pipe, along with a supply of cooling air from said cooling jacket, and wherein said plate supports fuel injector nozzles extending into said large diameter pipe.

8. The improved method of claim 5 wherein the supply of said fuel is monitored, and wherein an electrically powered igniter is disposed in said combustion zone, supplied with igniter fuel by a control system, and wherein said fuel is premixed and injected with the said waste, said waste being fluid capable of sustaining combustion at more than 5000 BTU's/lb.

9. The improved method of claim 7 wherein said supply of cooling air passes from an air intake control system through a blower into a cooling jacket around said large diameter pipe and into said small diameter pipe.

10. The improved method of claim 1 wherein said fuel is propane, wherein said fuel is injected at the rate of about 1 to about 5 lbs/min.into said combustion zone, wherein said air is supplied to said combustion zone at a flow rate of about 800 to 1300 scfm wherein said waste is kerosene and is supplied to said combustion chamber at the flow rate of about 1 to about 5 lbs/min., wherein the temperature in said combustion zone during incineration is about 1800° F. to about 2700° F. and wherein the waste residence time therein is about 0.08 to about 0.15 seconds.

11. An improved incinerator for hazardous waste materials, said incinerator comprising, in combination:

(a) a housing having a relatively small diameter waste and air inlet component, a relatively larger diameter elongated combustion chamber, and a step plate joining said inlet component to said combustion chamber;

(b) a fluidized waste injection line connected to said inlet component, and having an outlet nozzle extending radially about said inlet component for injecting fluidized waste directly inwardly to a combustion zone at the axis of rotation of said housing and combustion chamber in an area immediately downstream of said housing;

(c) at least one air inlet line connected to said inlet component and to a blower for supplying air at elevated pressure to said combustion zone;

(d) fuel injector nozzles extending through said plate and radially about said inlet component for injecting fuel directly inwardly to said combustion zone;

(e) fuel supply lines connected to said nozzles;

(f) a fuel ignition device extending through said inlet component into said combustion chamber adjacent said nozzles; and, (g) means for controlling the supply of said air, fuel and waste into said incinerator.

12. The improved waste incinerator of claim 11 wherein said inlet component and said combustion chamber are cylindrical pipes and are concentric and wherein said air inlet line comprises a space in a cooling jacket disposed around the sides of said inlet component and combustion chamber.

13. The improved waste incinerator of claim 12 wherein said fuel is hydrocarbon gas, wherein said igniter device is electrically powered and supplied with hydrocarbon gas, wherein said igniter device is electrically powered and supplied with hydrocarbon gas fuel and wherein said combustion chamber has an upstream end adjacent said plate and an open downstream end.

14. The improved waste incinerator of claim 11 wherein said incinerator is a sudden expansion burner adapted to receive and incinerate waste liquid, vapor fumes, entrained particles and slurries.

15. The improved waste incinerator of claim 14 wherein said combustion chamber is about 20 inches in diameter by about 200 inches in length wherein the combustion temperature is about 1800° F. to about 3500° F. therein and the waste residence time therein is about 0.08 to about 0.12 seconds.

16. The improved incinerator of claim 11, including means for terminating the fuel supply to said combustion zone after determining that the combustion of the waste material is capable of being self-sustaining.

* * * * *